US010319296B2

(12) United States Patent
Sawa et al.

(10) Patent No.: US 10,319,296 B2
(45) Date of Patent: Jun. 11, 2019

(54) DISPLAY DEVICE CORRECTION METHOD AND DISPLAY DEVICE CORRECTION DEVICE

(71) Applicant: JOLED INC., Tokyo (JP)

(72) Inventors: Kazuki Sawa, Tokyo (JP); Hiroshi Hayashi, Tokyo (JP); Tomoyuki Maeda, Tokyo (JP)

(73) Assignee: JOLED INC., Tokyo (JP)

( * ) Notice: Subject to any disclaimer, the term of this patent is extended or adjusted under 35 U.S.C. 154(b) by 66 days.

(21) Appl. No.: 15/507,394

(22) PCT Filed: Aug. 27, 2015

(86) PCT No.: PCT/JP2015/004318

§ 371 (c)(1),
(2) Date: Feb. 28, 2017

(87) PCT Pub. No.: WO2016/035294

PCT Pub. Date: Mar. 10, 2016

(65) Prior Publication Data

US 2017/0287397 A1 Oct. 5, 2017

(30) Foreign Application Priority Data

Sep. 1, 2014 (JP) ..... 2014-177494

(51) Int. Cl.
*G09G 3/3233* (2016.01)
*G09G 3/20* (2006.01)
*G09G 5/36* (2006.01)

(52) U.S. Cl.
CPC ..... *G09G 3/3233* (2013.01); *G09G 3/2007* (2013.01); *G09G 5/363* (2013.01);
(Continued)

(58) Field of Classification Search
CPC ..... G09G 2320/045; G09G 3/20; G09G 2320/0233; G09G 3/3233; G09G 3/2007; G09G 3/30; H01L 51/50
See application file for complete search history.

(56) References Cited

U.S. PATENT DOCUMENTS 8,599,186 B2 * 12/2013 Ogura ..... G09G 3/20 345/100
2003/0201727 A1 10/2003 Yamazaki et al.
(Continued)

FOREIGN PATENT DOCUMENTS

JP 2004-145257 5/2004

OTHER PUBLICATIONS

International Search Report, dated Nov. 17, 2015, in International Application No. PCT/JP2015/004318.

*Primary Examiner* — Bryan Earles
(74) *Attorney, Agent, or Firm* — Greenblum & Bernstein, P.L.C.

(57) ABSTRACT

A display device correction method performed by a control unit that performs display control on an organic electroluminescent (EL) panel including a plurality of display pixels, in an organic EL display which includes the organic EL panel and the control unit. The display device correction method includes: obtaining a cumulative value of a pixel signal supplied to a drive transistor which is included in a current pixel to be processed among the plurality of display pixels and supplies drive current according to the pixel signal to an organic EL element (OEL); calculating a shift amount of a threshold voltage of the drive transistor, using the cumulative value; calculating an amount of change in mobility, using the shift amount; and calculating a correction parameter for correcting a pixel signal, using the amount of change in mobility.

1 Claim, 7 Drawing Sheets

(52) U.S. Cl.
CPC ..... *G09G 2300/043* (2013.01); *G09G 2320/0233* (2013.01); *G09G 2360/16* (2013.01)

(56) References Cited

U.S. PATENT DOCUMENTS

| | | | | |
|---|---|---|---|---|
| 2005/0156831 | A1 | 7/2005 | Yamazaki et al. | |
| 2009/0081816 | A1 | 3/2009 | Yamazaki et al. | |
| 2011/0032281 | A1* | 2/2011 | Ietomi | G09G 3/3233 345/690 |
| 2011/0075038 | A1 | 3/2011 | Yamazaki et al. | |
| 2012/0120126 | A1 | 5/2012 | Yamazaki et al. | |
| 2012/0299987 | A1 | 11/2012 | Yamazaki et al. | |
| 2014/0015824 | A1* | 1/2014 | Chaji | G09G 3/32 345/212 |
| 2015/0154908 | A1* | 6/2015 | Nam | G09G 3/3233 345/76 |
| 2015/0213757 | A1* | 7/2015 | Takahama | G09G 3/3266 345/691 |
| 2015/0379940 | A1* | 12/2015 | Kishi | G09G 3/3225 345/690 |
| 2017/0025061 | A1* | 1/2017 | Takizawa | G09G 3/3233 |

* cited by examiner

DISPLAY DEVICE CORRECTION METHOD AND DISPLAY DEVICE CORRECTION DEVICE

TECHNICAL FIELD

The present disclosure relates to a display device correction method and a display device correction device.

BACKGROUND ART

In recent years, organic electroluminescent (EL) displays which make use of organic electroluminescence have been the focus of attention as one of next-generation flat panel displays to replace liquid-crystal displays.

The organic EL displays include an organic EL panel in which a plurality of display pixels are disposed in a matrix. The display pixel includes an organic EL element and a drive transistor which supplies drive current according to a pixel signal to the organic EL element.

In active-matrix display devices such as organic EL displays, thin-film transistors (TFTs) are used as drive transistors. In a TFT, a threshold voltage of the TFT shifts over time due to stress caused by, for example, a gate-source voltage when the TFT is powered up. The shift of the threshold voltage with the passage of time may cause variation in the amount of current supplied to an organic EL element, and thus affects luminance control of the display device, leading to deterioration of the display quality.

In the organic EL display, in order to prevent deterioration of the display quality, a cumulative value of a pixel signal (hereinafter referred to as "cumulative value" as appropriate) is calculated, and a pixel signal is corrected using the cumulative value. The pixel signal is a signal included in a video signal indicating an image of one frame, and includes chromaticity, saturation, a gradation value, etc., of one pixel.

CITATION LIST

Patent Literature

[PTL 1] Japanese Unexamined Patent Application Publication No. 2004-145257

SUMMARY OF INVENTION

Technical Problem

However, the conventional display devices pose a problem that accuracy of correction of the gradation value is not sufficient, and thus further improvement in the display quality is required.

The present disclosure provides a display device correction method and a display device correction device which are capable of improving the display quality.

Solution to Problem

A display device correction method according to the present disclosure is a display device correction method performed by a control unit that performs display control on a display panel including a plurality of display pixels, in a display device which includes the display panel and the control unit. The display device correction method includes: obtaining a cumulative value of a pixel signal supplied to a drive transistor which is included in a current pixel to be processed among the plurality of display pixels and supplies drive current according to the pixel signal to a light emitting element; calculating a shift amount of a threshold voltage of the drive transistor, using the cumulative value; calculating an amount of change in mobility, using the shift amount; and calculating a correction parameter for correcting a gradation value of the pixel signal, using the amount of change in mobility.

A display device correction device according to the present disclosure is a display device correction device including: a display panel including a plurality of display pixels; and a control unit configured to perform display control on the display panel. In the display device correction device, each of the plurality of display pixels includes a light emitting element, and a drive transistor which supplies drive current according to a pixel signal to the light emitting element, and the control unit is configured to: obtain a cumulative value of the pixel signal supplied to the drive transistor which is included in a current pixel to be processed among the plurality of display pixels; calculate a shift amount of a threshold voltage of the drive transistor, using the cumulative value; calculate an amount of change in mobility, using the shift amount; and calculate a correction parameter for correcting a gradation value of the pixel signal, using the amount of change in mobility.

Advantageous Effects of Invention

The display device correction method and the display device correction device according to the present disclosure are capable of improving the display quality.

DESCRIPTION OF EMBODIMENTS

[Details of the Problem]

Figure 1:
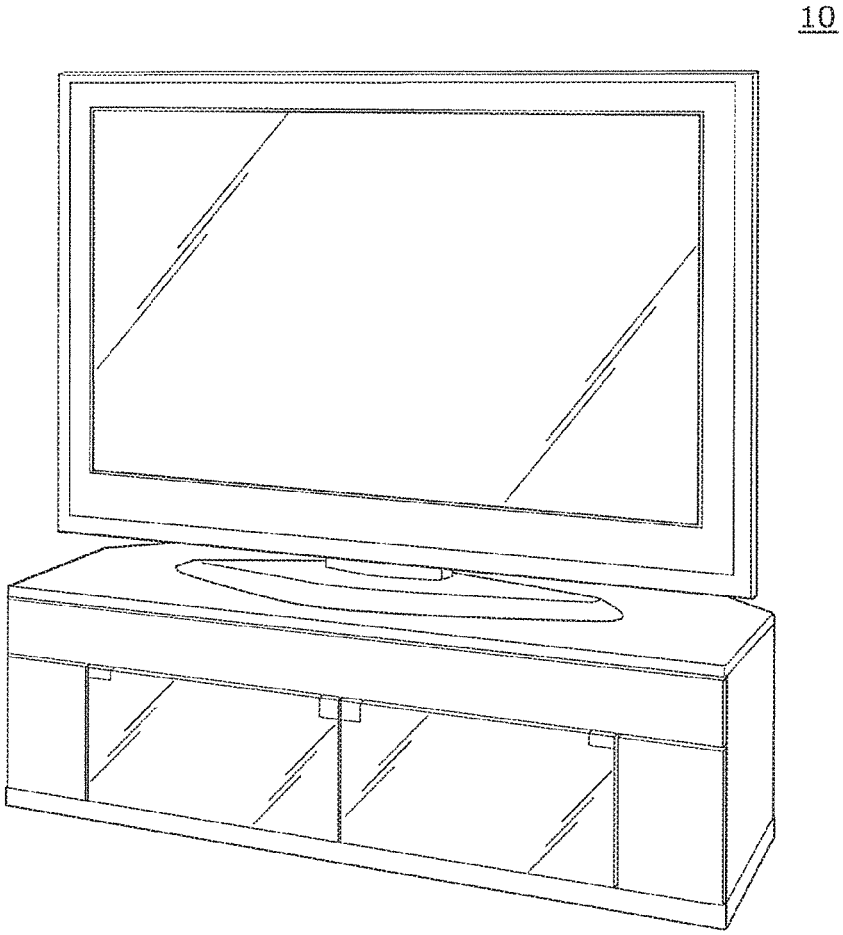
FIG. 1 is an appearance diagram which illustrates an external view of an organic EL display according to an embodiment.

Correction performed on a pixel signal includes, for example, (1) correction of a gradation value with respect to a shift of a threshold voltage, (2) correction of a gradation value using mobility of electric charges in a drive transistor, etc.

(1) the correction of a gradation value with respect to a shift of a threshold voltage is carried out in order to prevent reduction of luminance of an organic EL panel due to deterioration of a drive transistor which results from application of a voltage across a gate and a source of the drive transistor. When a voltage is applied across the gate and source of the drive transistor, the drive transistor deteriorates over time, and the threshold voltage shifts. When the threshold voltage shifts, the amount of drive current flowing across the source and the drain of the drive transistor decreases even in the case where the same voltage is applied to the gate. With this, the amount of the drive current supplied to the organic EL element decreases, leading to reduction in luminance of the organic EL element. In correcting of a gradation value using the shift amount of a threshold voltage, the relationship between a cumulative value of a pixel signal and a shift amount of a threshold voltage is used. The cumulative value of the pixel signal is calculated according to the relationship, thereby obtaining the shift amount of the threshold voltage.

(2) In the correction using mobility of electric charges in a drive transistor, mobility is obtained according to the amount of current flowing through the drive transistor, and a gradation value is corrected using the mobility.

Conventionally, the above-described two corrections are separately carried out.

Here, the inventors have found that there is a correlation between the above-described shift amount of the threshold voltage and the amount of change in mobility. It is considered that performing of the correction of a gradation value using the correlation allows correcting the gradation value with higher accuracy, and improving the display quality.

Hereinafter, embodiments shall be discussed in detail with reference to the drawings as necessary. However, description that is too detailed will be omitted in some cases. For example, there are instances where detailed description of well-known matter and redundant description of substantially identical components are omitted. This is for the purpose of preventing the following description from being unnecessarily redundant and facilitating understanding of those skilled in the art.

It should be noted that the accompanying Drawings and subsequent description are provided by the inventors to allow a person of ordinary skill in the art to sufficiently understand the present disclosure, arid are thus not intended to limit the scope of the subject matter recited in the Claims.

(Embodiment)

Hereinafter, a display device correction method and a display device correction device according to an embodiment is described with reference to FIG. 1 to FIG. 7.

[1-1. Configuration]

Figure 2:
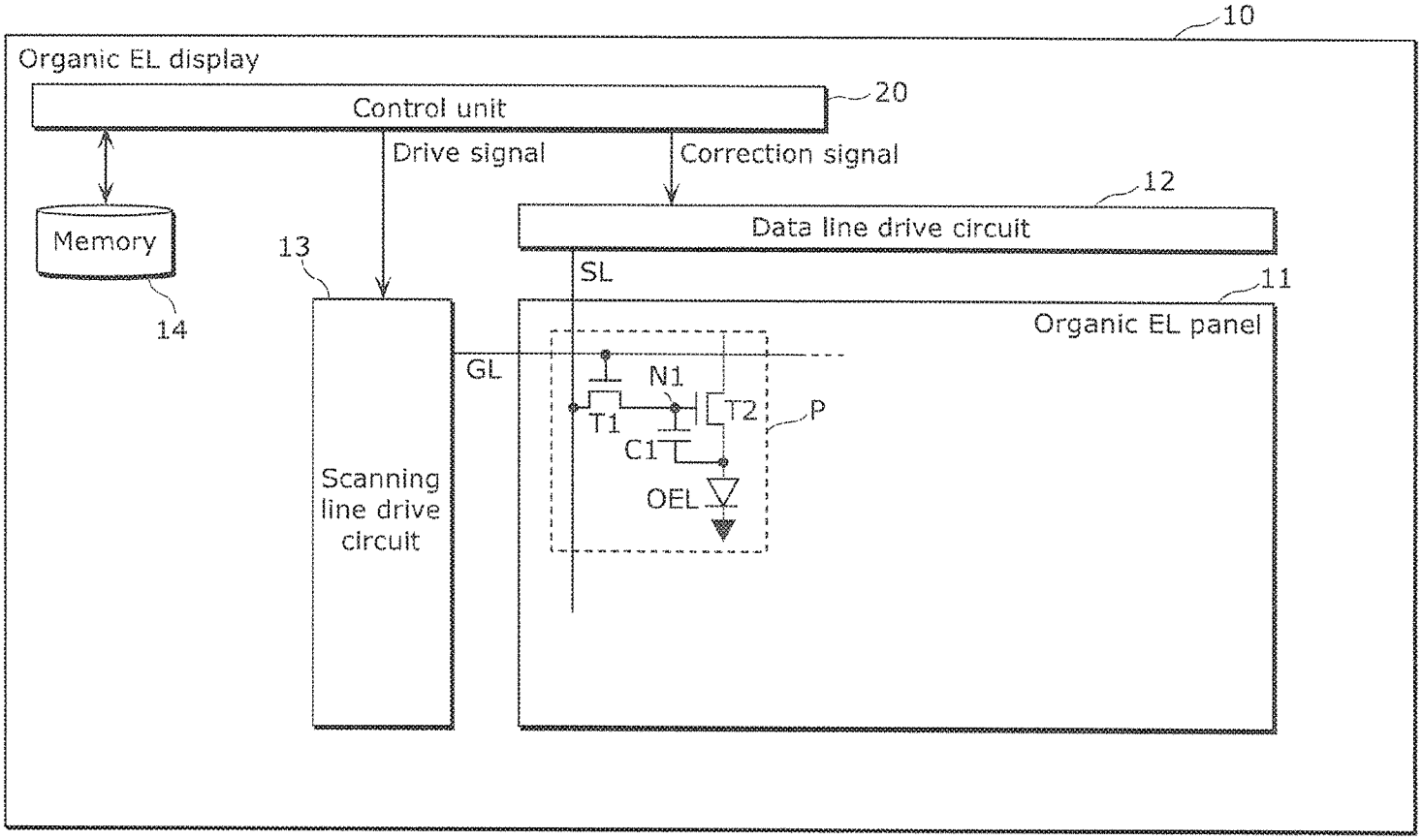
FIG. 2 is a block diagram which illustrates an example of a configuration of the organic EL display according to the embodiment.

FIG. 1 is an appearance diagram which illustrates an external view of an organic EL display 10 according to the present embodiment. FIG. 2 is a block diagram which illustrates an example of a configuration of the organic EL display 10 according to the present embodiment.

As illustrated in FIG. 2, the organic EL display 10 includes an organic EL panel 11, a data line drive circuit 12, a scanning line drive circuit 13, a memory 14, and a control unit 20.

(1-1-1. Organic EL Panel, Drive Circuit, and Memory)

The organic EL panel 11 is an example of a display panel including a plurality of display pixels. The organic EL panel 11 includes a plurality of display pixels P which are disposed in a matrix, a plurality of scanning lines GL connected to the plurality of display pixels P, and a plurality of data lines SL.

According to the present embodiment, the plurality of display pixels P each include an organic EL element OEL, a selection transistor T1, a drive transistor T2, and a capacitative element C1.

The selection transistor Ti switches between selection and non-selection of the display pixel P according to a voltage of the scanning line GL. The selection transistor T1 is a thin-film transistor, and includes a gate terminal connected to the scanning line GL, a source terminal connected to the data line SL, and a drain terminal connected to the node N1.

The drive transistor T2 supplies drive current according to a voltage of the data line SL to the organic EL element OEL. The drive transistor T2 is a thin-film transistor. More specifically, the drive transistor T2 is an oxide semiconductor element. For example, the drive transistor T2 is formed using an oxide semiconductor such as a transparent amorphous oxide semiconductor (TAOS). The drive transistor T2 includes a gate terminal connected to the node N1, a source terminal connected to an anode electrode of the organic EL element OEL, and a drain terminal to which a voltage VTFT is supplied.

The organic EL element OEL is a light emitting element that emits light according to drive current. The drive current is supplied from the drive transistor T2. The organic EL element OEL includes an anode electrode connected to the source terminal of the drive transistor T2, and a cathode electrode which is grounded.

The capacitative element C1 is a capacitative element in which an electric charge according to the voltage of the data line SL is accumulated. The capacitative element C1 has one end connected to the node N1 and the other end connected to the source terminal of the drive transistor T2.

The data line drive circuit 12 supplies, to the plurality of data lines SL, a voltage according to a correction signal provided by the control unit 20.

The scanning line drive circuit 13 supplies, to the plurality of scanning lines GL, a voltage according to a drive signal provided by the control unit 20.

It should be noted that, although the case where the selection transistor T1 and the drive transistor T2 are n-type TFTs is described as an example in the present embodiment, the selection transistor T1 and the drive transistor T2 may be p-type TFTs. The capacitative element C1 is connected between the gate and the source of the drive transistor T2, in this case as well.

The memory 14 includes a volatile memory and a non-volatile memory according to the present embodiment. The volatile memory is, for example, a dynamic random access memory (DRAM) or a static random access memory (SRAM). The non-volatile memory is, for example, a flash memory. In the memory 14, a correction parameter for correcting a video signal, a result of calculation, etc., are stored, (1-1-2. Control Unit)

The control unit 20 is a circuit which controls video display on the organic EL panel 11, and is configured using, for example, timing controller (TCOM) or the like. It should be noted that the control unit 20 may be configured using a computer system including a micro controller, a system large scale integration (LSI), or the like.

The control unit 20 controls correction processing on a video signal provided from outside, writing processing using the corrected video signal, etc. The video signal is a signal for displaying an image including one frame on the organic EL panel 11. The video signal includes pixel signals corresponding one to one to a plurality of pixels included in the image indicated by the video signal. The pixel signal includes chromaticity, saturation, a gradation value, etc.

The correction processing performed on the video signal includes correction of a gradation value of the pixel signal, as described above. The correction of the gradation value of the pixel signal is performed to address deterioration of the drive transistor. The control unit 20 generates a correction signal resulting from correcting the gradation value, and outputs the correction signal to the data line drive circuit 12.

Figure 3:
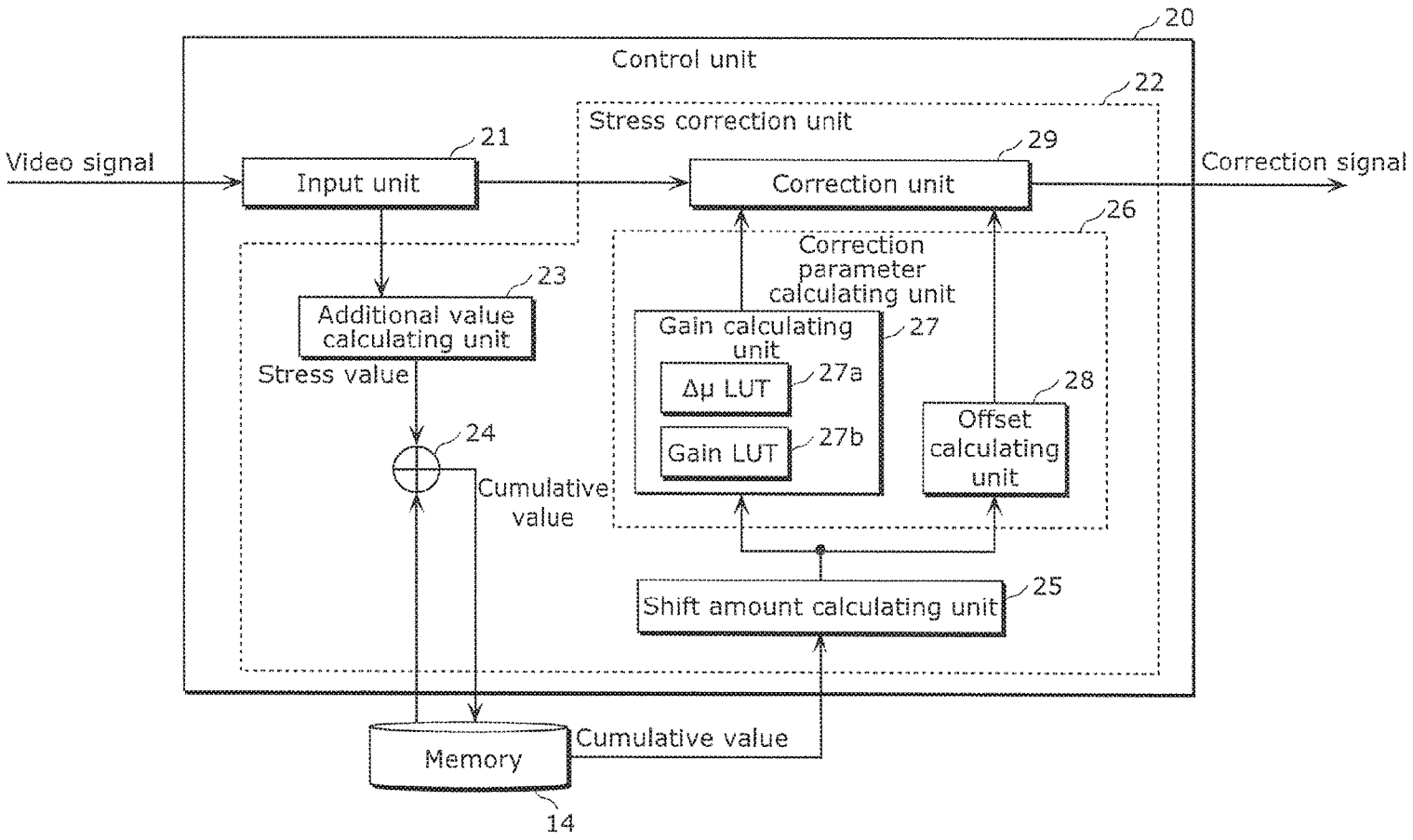
FIG. 3 is a block diagram which illustrates an example of a configuration of a control unit according to the embodiment.

FIG. 3 is a block diagram which illustrates an example of a configuration of the control unit 20 according to the present embodiment. FIG. 3 illustrates part of structural components of the control unit 20, which is a portion related to the stress correction. Although the control unit 20 includes, in addition to the structural components illustrated in FIG. 3, a circuit which generates a drive signal, etc., illustration for those structural components is omitted.

As illustrated in FIG. 3, the control unit 20 includes an input unit 21 and a stress correction unit 22. The control unit 20 corresponds to the correction device according to the present embodiment.

The input unit 21 receives a video signal provided from outside, and performs adjustment of an image size, etc. The input unit 21 sequentially obtains a gradation value of each of the plurality of display pixels P included in the organic EL panel 11, and outputs the obtained gradation value to an additional value calculating unit 23 and a correction unit 29.

The stress correction unit 22 performs stress correction using a cumulative value of stress of the drive transistor T2. As illustrated in FIG. 3, the stress correction unit 22 includes the additional value calculating unit 23, an adder 24, a shift amount calculating unit 25, a correction parameter calculating unit 26, and a correction unit 29.

The additional value calculating unit 23 calculates a stress value of the drive transistor included in the display pixel P, on the basis of the gradation value of the pixel signal. The stress value of the drive transistor T2 is a value corresponding to the gradation value of the pixel signal and the cumulative value stored in the memory 14. The additional value calculating unit 23 calculates, as a stress value, a time conversion value under the assumption that a voltage of a constant value is continuously applied.

The adder 24 rewrites, on the memory 14, a value resulting from adding the stress value to the cumulative value stored in the memory 14, as a new cumulative value.

The shift amount calculating unit 25 calculates a shift amount of a threshold voltage of the drive transistor T2, using the cumulative value stored in the memory 14.

The correction parameter calculating unit 26 calculates a correction parameter for correcting a gradation value of the pixel signal. The correction unit 29 which will be described later corrects a gradation value using an expression; that is, gradation value×gain A+offset B. The correction parameter calculating unit 26 includes a gain calculating unit 27 and an offset calculating unit 28.

The gain calculating unit 27 calculates a change amount in mobility using a shift amount, and calculates a gain A using the mobility. The gain calculating unit 27 includes two look-up tables of Δμ LUT 27*a* and gain LUT 27*b*. The details of the look-up tables will be described later.

The offset calculating unit 28 calculates an offset B using the shift amount.

The correction unit 29 corrects the gradation value using the expression; that is, gradation value×gain A+offset B, as described above, and outputs the corrected gradation value as a correction signal.

(1-2. Operation)

Figure 4:
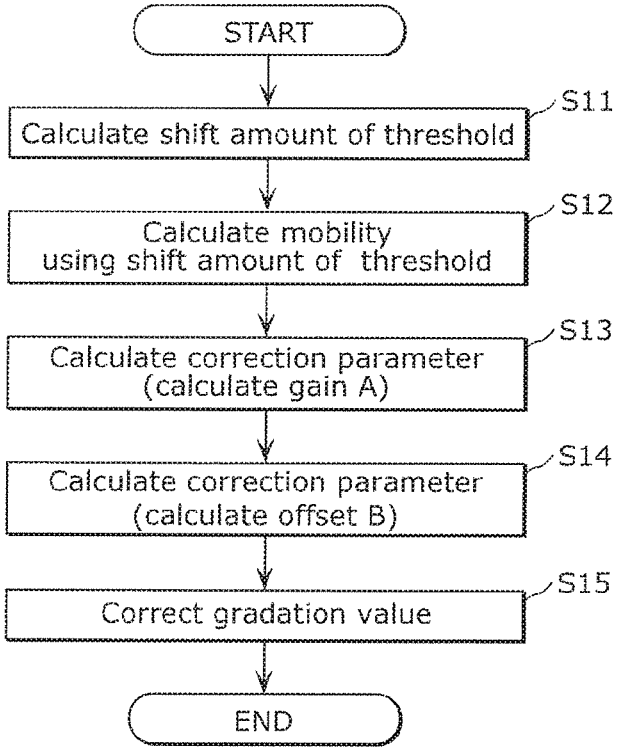
FIG. 4 is a flowchart which illustrates a procedure of stress correction according to the embodiment.

FIG. 4 is a flowchart which illustrates a procedure of stress correction according to the present embodiment.

(1-2-1. Calculation of Shift Amount of Threshold)

The shift amount calculating unit 25 calculates a shift amount $\Delta V_{th}$ of a threshold voltage of the drive transistor T2, using the cumulative value stored in the memory 14 (S11). The shift amount $\Delta V_{th}$ of a threshold voltage is obtained using Expression 1 below.

[Math. 1]

$$\Delta V_{th}=A_1(V_{gs}-V_{th}+V_{offset})^{\alpha}t_{ref}^{\beta} \quad \text{Expression 1}$$

$V_{gs}$ denotes a gate-source voltage of the drive transistor T2, $V_{th}$ denotes a threshold voltage of the drive transistor T2 and a design value. In addition, $t_{ref}$ denotes a time conversion value (i.e., cumulative value) of stress.

Figure 5:
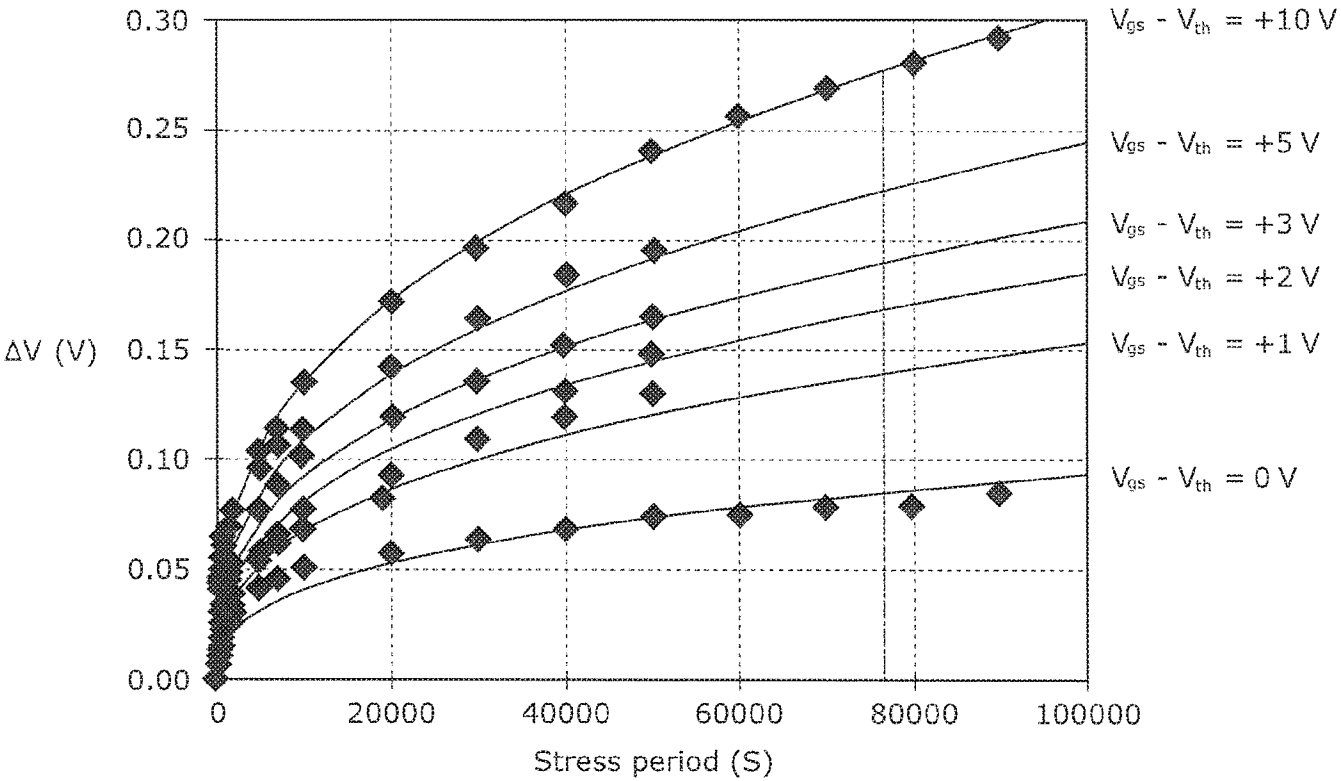
FIG. 5 is a graph which illustrates a result of measuring a shift amount of a threshold voltage with respect to a cumulative value, for each design value denoted by ($V_{gs}$–$V_{th}$).

FIG. 5 is a graph which illustrates a result of measuring a shift amount $\Delta V_{th}$ of a threshold voltage with respect to a cumulative value $t_{ref}$ (denoted as a stress period in FIG. 5), for each design value denoted by $(V_{gs}-V_{th})$. $A_1$, α, β, and $V_{offset}$ of Expression 1 are obtained by performing fitting according to the least-square technique, for the graph in FIG. 5. $A_1$, α, β, and $V_{offset}$ according to the design value are stored in advance in the memory 14 of the organic EL display 10. The shift amount calculating unit 25 calculates a shift amount $\Delta V_{th}$ of a threshold voltage, by assigning the cumulative value $T_{ref}$ to Expression 1.

(1-2-2. Calculation of Mobility)

The gain calculating unit 27 of the correction parameter calculating unit 26 calculates a change amount Δμ in mobility, using the shift amount $\Delta V_{th}$ of the threshold (S12). The change amount Δμ in mobility is obtained using Expression 2 below.

[Math. 2]

$$\Delta\mu=C\times(\Delta V_{th})^{\gamma} \quad \text{Expression 2}$$

Figure 6:
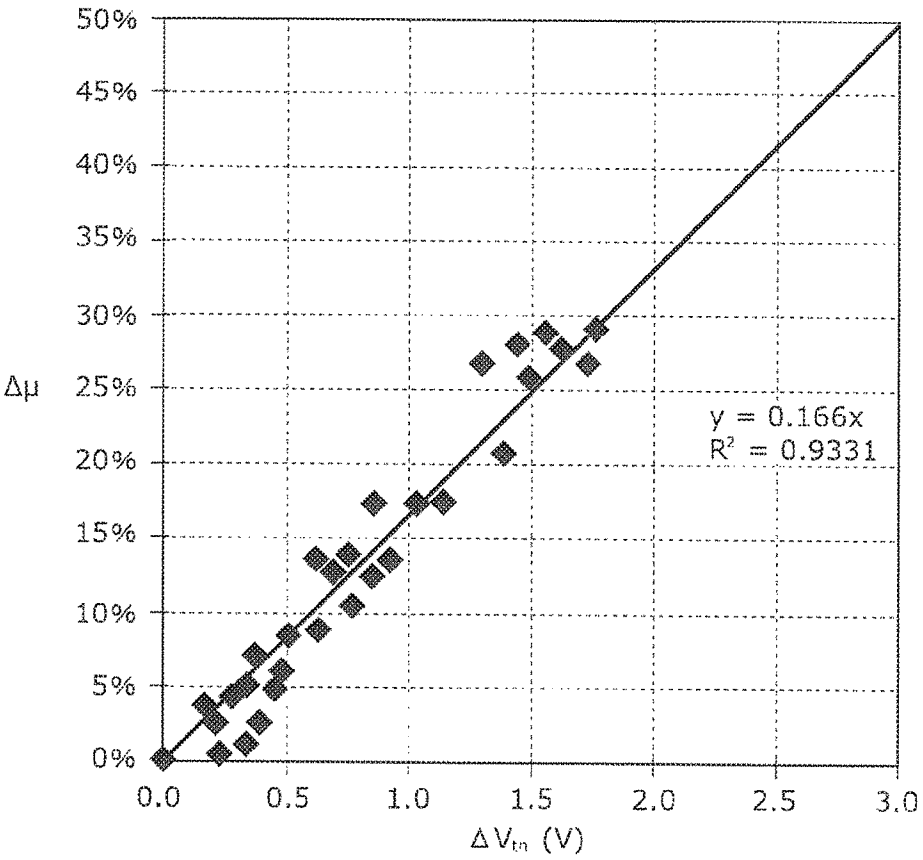
FIG. 6 is a graph which illustrates a result of measuring a change amount in mobility with respect to a shift amount of the threshold voltage.

FIG. 6 is a graph which illustrates a result of measuring a change amount Δμ in mobility with respect to a shift amount $\Delta V_{th}$ of the threshold voltage (an example of Δμ LUT 27*a*). It is possible to obtain C and γ using FIG. 6. C and γ are stored in advance in the memory 14 of the organic EL display 10. The gain calculating unit 27 assigns the shift amount $\Delta V_{th}$ to Expression 2, thereby calculating the change amount Δμ in mobility. It should be noted that an expression $\Delta\mu=C_1\times(\Delta V_{th})^{\gamma}+C_2$ may be used. Expression 2 is used in the case where $C_2=0$.

(1-2-3. Calculation of Correction Parameter 1; Calculation of Gain A)

The gain calculating unit 27 calculates the gain A, using the change amount Δμ in mobility (S13).

The gain A is obtained according to Expression 3 below.

[Math. 3]

$$A=\sqrt[\delta]{\frac{1}{(1+\Delta\mu)}} \quad \text{Expression 3}$$

Figure 7:
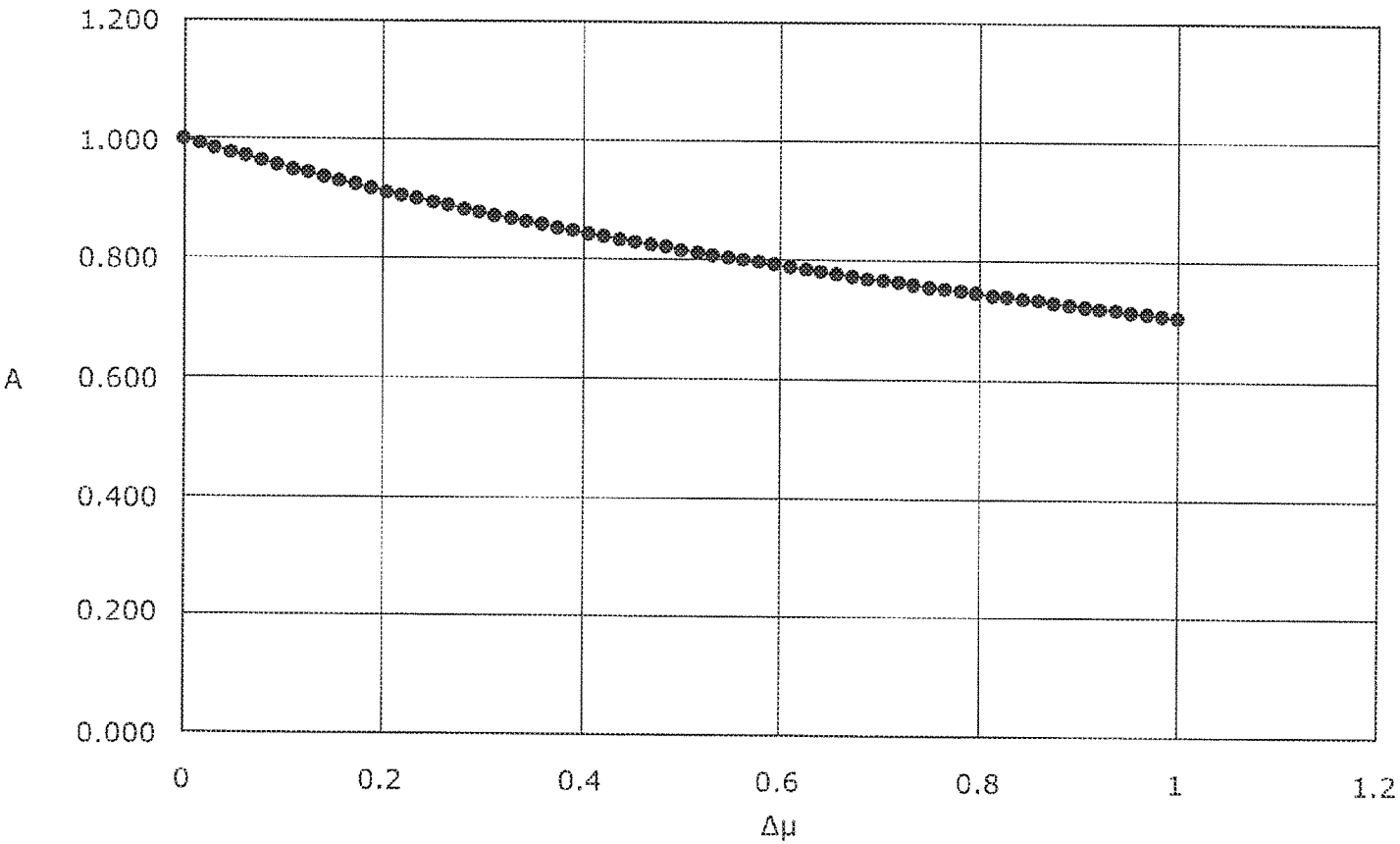
FIG. 7 is a graph which illustrates a value of gain with respect to the change amount of the mobility.

FIG. 7 is a graph which illustrates a value of a gain A with respect to the change amount Δμ in mobility (an example of the gain LUT 27*b*). For example, the graph illustrated in FIG. 7 is obtained by measuring a value of the gain A with respect to the change amount Δμ in mobility, for the first one of a lot. It is possible to obtain δ, using the graph in FIG. 7. In FIG. 7, δ=1.

The gain calculating unit 27 assigns the change amount Δμ in mobility to Expression 3, thereby calculating the gain A.

(1-2-4. Calculation of Correction Parameter 2: Calculation of Offset B)

The offset calculating unit 28 calculates an offset B using the shift amount of a threshold (S14). The offset B is obtained according to Expression 4 below, using a constant a.

[Math. 4]

$$B=\Delta V_{th}\times\alpha \quad \text{Expression 4}$$

(1-2-5. Correction of Gradation Value)

The correction unit 29 corrects a gradation value $V_{data}$ of a pixel signal, using the gain A and the offset B (S15). A corrected gradation value $V_{data}'$ is obtained according to Expression 5 below.

[Math. 5]

$$V_{data}'=A\times V_{data}+B \quad \text{Expression 5}$$

(1-3. Advantageous Effects, etc.)

With the correction device and the correction method according to the present embodiment, a gradation value is corrected using a relationship between the shift amount $\Delta V_{th}$ of the threshold voltage and the change amount $\Delta\mu$ in mobility. In this manner, with the correction device and the correction method according to the present embodiment, it is possible to correct a gradation value with higher accuracy.

(Other Embodiments)

As described above, the embodiment is described as an exemplification of the technique according to the present disclosure. The accompanying drawings and detailed description are provided for this purpose.

Therefore, the structural components described in the accompanying drawings and detailed description include, not only the structural components essential to solving the problem, but also the structural components that are not essential to solving the problem but are included in order to exemplify the aforementioned technique. As such, description of these non-essential structural components in the accompanying drawings and the detailed description should not be taken to mean that these non-essential structural components are essential.

Furthermore, since the foregoing embodiment is for exemplifying the technique according to the present disclosure, various changes, substitutions, additions, omissions, and so on, can be carried out within the scope of the Claims or its equivalents.

INDUSTRIAL APPLICABILITY

The present disclosure can be applied to display devices such as organic EL displays.

The invention claimed is:

1. A display device correction method performed by a controller that performs display control on a display panel including a plurality of display pixels, in a display device which includes the display panel and the controller, the display device correction method comprising:

obtaining a cumulative value of a pixel signal supplied to a drive transistor which is included in a current pixel to be processed among the plurality of display pixels and supplies drive current according to the pixel signal to a light emitting element;

calculating a shift amount of a threshold voltage of the drive transistor, using the cumulative value;

calculating an amount of change in mobility, using the shift amount; and calculating a correction parameter for correcting a gradation value of the pixel signal, using the amount of change in mobility, wherein in the calculating of the amount of change in mobility, the amount of change in mobility is calculated so as to satisfy a relational expression $\Delta\mu=C_1(\Delta V_{th})^{\gamma}+C_2$, where $\Delta V_{th}$ denotes the shift amount, and $\Delta\mu$ denotes the amount of change in mobility, and coefficients $C_1$, $C_2$, and $\gamma$ are each a value calculated in advance using an actual measured value of the amount of change in mobility with respect to the shift amount, and wherein in the calculating of the shift amount, the shift amount is calculated so as to satisfy a relational expression $\Delta V_{th}=A(V_{gs}-V_{th}+V_{offset})^{\alpha}t^{\beta}$, where t denotes the cumulative value, and $V_{gs}-V_{th}$ denotes a design value of a difference between a gate-source voltage of the drive transistor and the threshold voltage, and coefficients A, $V_{offset}$, $\alpha$, and $\beta$ are each a value calculated in advance using a graph indicating an actual measured value of the shift amount with respect to the cumulative value.

* * * * *